US011576549B2

(12) United States Patent
Goff

(10) Patent No.: US 11,576,549 B2
(45) Date of Patent: Feb. 14, 2023

(54) FLOOR MAINTENANCE MACHINE WITH SERVICE CABINET

(71) Applicant: RPS Corporation, Racine, WI (US)

(72) Inventor: Sean K. Goff, Breckenridge, CO (US)

(73) Assignee: RPS Corporation, Racine, WI (US)

( * ) Notice: Subject to any disclaimer, the term of this patent is extended or adjusted under 35 U.S.C. 154(b) by 384 days.

(21) Appl. No.: 16/942,358

(22) Filed: Jul. 29, 2020

(65) Prior Publication Data

US 2020/0352406 A1 Nov. 12, 2020

Related U.S. Application Data

(63) Continuation of application No. 15/886,521, filed on Feb. 1, 2018, now Pat. No. 10,765,285.

(51) Int. Cl.

| | |
|---|---|
| ***A47L 11/40*** | (2006.01) |
| ***A47L 11/03*** | (2006.01) |
| ***A47L 11/16*** | (2006.01) |
| ***A47L 11/30*** | (2006.01) |
| ***A47L 11/14*** | (2006.01) |

(52) U.S. Cl.

CPC ..... *A47L 11/4025* (2013.01); *A47L 11/03* (2013.01); *A47L 11/161* (2013.01); *A47L 11/305* (2013.01); *A47L 11/4005* (2013.01); *A47L 11/4083* (2013.01); *A47L 11/4088* (2013.01); *A47L 11/145* (2013.01)

(58) Field of Classification Search

CPC .... A47L 11/4025; A47L 11/03; A47L 11/161; A47L 11/305

See application file for complete search history.

(56) References Cited

U.S. PATENT DOCUMENTS

| | | | | |
|---|---|---|---|---|
| 5,048,148 | A | 9/1991 | Gleadell | |
| 2016/0331201 | A1 | 11/2016 | Goff | |
| 2017/0258284 | A1 * | 9/2017 | Robinson | A47L 11/4072 |

* cited by examiner

*Primary Examiner* — Andrew A Horton

(74) *Attorney, Agent, or Firm* — Quarles & Brady LLP

(57) ABSTRACT

A floor maintenance machine includes a chassis, a floor-cleaning implement adapted for engagement with the floor, and a service cabinet. The floor-cleaning implement is supported by the chassis. The service cabinet is coupled to the chassis and defines a cavity. The cavity receives a plurality of fluid access points collectively therein.

20 Claims, 3 Drawing Sheets

FLOOR MAINTENANCE MACHINE WITH SERVICE CABINET

CROSS-REFERENCES TO RELATED APPLICATIONS

This application is a continuation application of U.S. non-provisional patent application Ser. No. 15/886,521 filed Feb. 1, 2018, which is hereby incorporated by reference for all purposes as if set forth in its entirety herein.

BACKGROUND

This disclosure relates to floor maintenance machines and, in particular, to consolidating management of and access to supporting fluid subsystems.

Floor maintenance machines or scrubbers provide a way to clean dirty floor surfaces. Typically, an operator directs a floor maintenance machine over the surface to be cleaned by steering or guiding the floor maintenance machine. With the help of a supplied cleaning fluid, an oscillating pad or rotating brushes of the floor maintenance machine can directly contact the floor surface to loosen debris that is on the surface of the floor. A variety of pads and suction devices on the floor maintenance machine can be used to then remove the loosened debris from the floor surface to clean the floor.

In order to clean a dirty floor surface, the floor maintenance machine has a variety of subsystems positioned about the machine chassis. Fluid collection systems, cleaning solution distribution systems, machine power systems, and the like can be positioned throughout the machine to allow the introduction and removal of fluid and debris and to power the machine.

Many of the subsystems positioned about the machine chassis include valves, drains, and filters that require periodic maintenance or replacement. Because these components are placed about the machine chassis sporadically for manufacturability purposes, they are often difficult to reach by the operator and, in some cases, can require opening the machine or even disassembly to access or view these components. Because the various valves, drains, and filters are difficult to access, these components often go unchecked and without maintenance for much longer than recommended and this can result in decreased performance and potentially damage to the machine that requires expensive repair.

BRIEF SUMMARY

Disclosed herein is an improved floor maintenance machine with a service cabinet for housing valves, drains, and filters within a common, centralized structure. The service cabinet is coupled to an exterior of the machine chassis, for example, at a height below a tank on the floor maintenance machine. The service cabinet can be easily viewed and accessed from the outside of the floor maintenance machine at a single location and may be positioned in order to direct fluid (for some of the associated drains) away from the floor maintenance machine.

According to one aspect, a floor maintenance machine has a chassis, a floor cleaning implement adapted for engagement with the floor, and a service cabinet. The floor cleaning implement is supported by the chassis and the service cabinet is coupled to the chassis. The service cabinet defines a cavity that receives a plurality of fluid access points collectively therein. These fluid access points can all connect to various subsystems throughout the floor maintenance machine and may provide a single location for checking various fluids, draining fluids, and so forth related to these subsystems.

In some forms, the plurality of fluid access points may include a plurality of fluid drains extending outward from the cavity to direct fluid away from the service cabinet toward an external environment. For example, at least one of the plurality of drains can be in fluid communication with a battery box that surrounds a lead acid battery and can direct liquid contained within the battery box outward from the battery box, into the cavity, and away from the service cabinet toward the external environment. As another example, at least one of the plurality of drains may be placed in fluid communication with a portion of a vacuum pathway to direct liquid away from a vacuum pump, into the cavity, and away from the service cabinet. As still another example, a water trap may be placed in fluid communication with a portion of the vacuum pathway and may be positioned upstream of an outlet of the drain(s) used to direct liquid away from the pump. The water trap can provide a visible indication when liquid is present within the vacuum pathway (e.g., water was in the vacuum pump). At least one of the plurality of drains can be placed in fluid communication with a detergent reservoir to direct fluid outward from the detergent reservoir, into the cavity, and away from the service cabinet toward the external environment.

In some forms, the plurality of fluid access points may include a plurality of fluid filters removably received within the cavity. For example, one of the plurality of filters may be placed in fluid communication with a detergent reservoir and a solution valve that directs cleaning solution toward the floor cleaning implement. As another example, one of the plurality of fluid filters may be placed in fluid communication with an ozone production apparatus, a water reservoir, and an ozone discharge to direct ozone toward the floor cleaning implement as well.

In some forms, the plurality of fluid access points may include a plurality of valves to selectively restrict the flow of fluid outward from the service cabinet toward the external environment. For example, the plurality of valves can include at least one check valve in fluid communication with a fluid collection system. In some forms, the check valve may be a duckbill valve. The plurality of valves may also include at least one ball valve.

In some forms, the cavity of the service cabinet may be doorless and open to an external environment. An illumination source can be received within the cavity. For example, the illumination source can comprise a light emitting diode (LED) strip. The service cabinet can comprise a corrosion-resistant material. The service cabinet can have a plurality of walls extending away from a base surface to define the cavity. In some aspects, the service cabinet can be coupled to the chassis at a position above a rear wheel of the floor maintenance machine. At least one fluid access port can extend entirely through the cavity to an external environment.

These and still other advantages of the disclosure will be apparent from the detailed description and drawings. What follows is merely a description of some preferred embodiments of the present disclosure. To assess the full scope of the disclosure, the claims should be looked to as these preferred embodiments are not intended to be the only embodiments within the scope of the claims.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

Although the drawings represent embodiments of the present disclosure, the drawings are not necessarily to scale and certain features may be exaggerated in order to better illustrate and explain the embodiments of the present disclosure.

DETAILED DESCRIPTION

For the purposes of promoting an understanding of the principles of the present disclosure, reference will now be made to a number of illustrative embodiments shown in the attached drawings and specific language will be used to describe the same.

Figure 1:
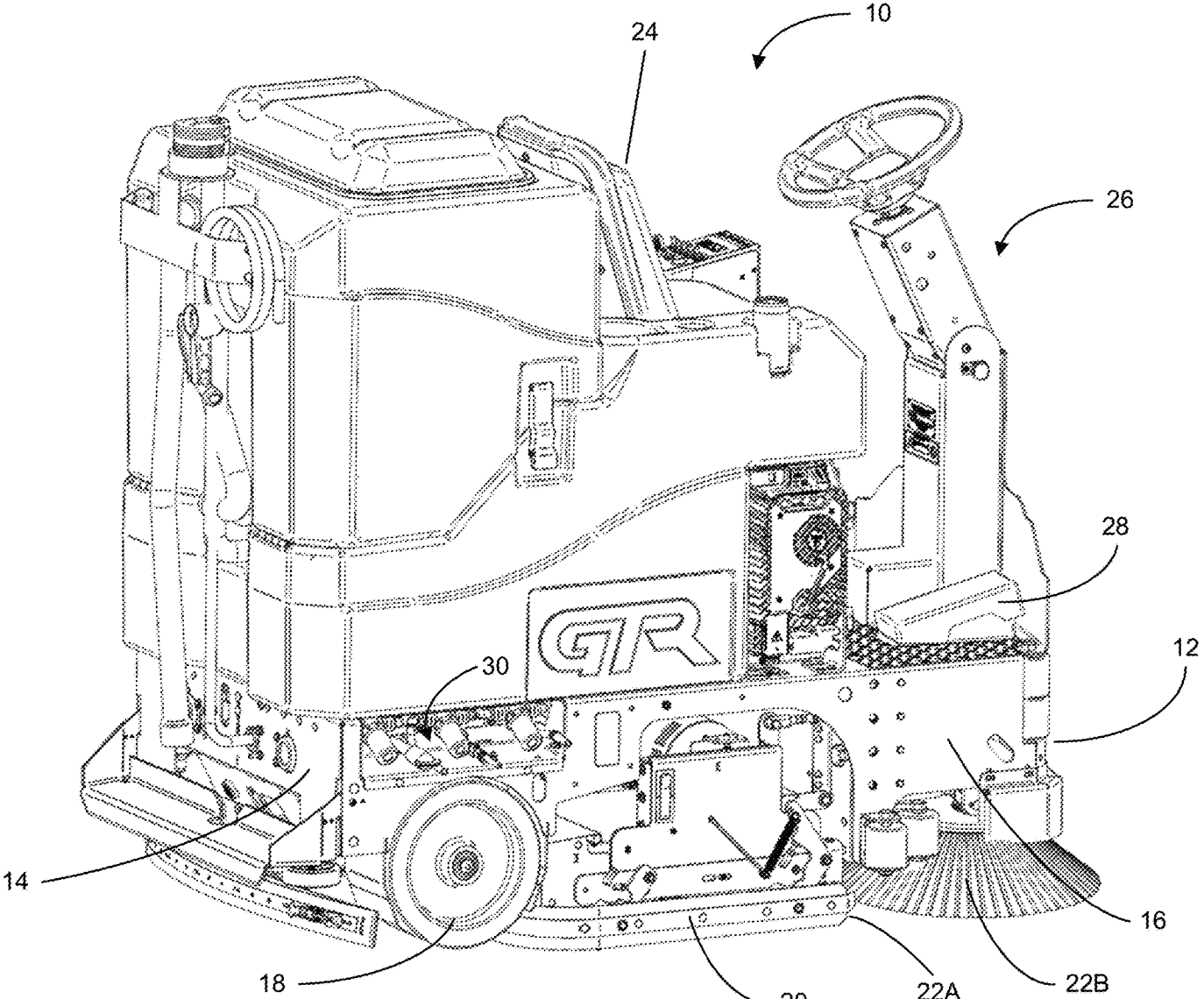
FIG. 1 is a side-rear perspective view of a floor maintenance machine.

FIG. 1 illustrates a floor maintenance machine 10 according to an embodiment of the disclosure. The floor maintenance machine 10 has a front end 12 and a rear end 14 along which a chassis 16 of the floor maintenance machine 10 extends. A set of wheels 18 are mounted to the chassis 16 and are positioned to engage and drive the floor maintenance machine 10 upon a floor surface. A housing extends over a portion of the chassis 16 to enclose various fluid handling and power systems used by the floor maintenance machine 10. A scrub deck 20 including a floor-cleaning implement 22A is supported by the chassis 16, and is adapted for engagement with the floor surface. For example, the floor-cleaning implement 22A could be a scrubber, a rotating brush, an oscillating pad, or other type of implement capable of mechanically altering debris present upon the floor surface. Additional floor-cleaning implements 22B can be present on the floor maintenance machine 10. For example, two rotating side brooms 22B can be positioned near the front end 12 of the floor maintenance machine 10, and can be supported by the chassis 16. The side brooms 22B rotate to direct debris inward toward the path of the floor maintenance machine 10 as it travels. As illustrated in FIG. 1, the floor maintenance machine 10 can be a riding-type machine and can include an operator seat 24 and a steering mechanism 26 and pedal 28 to control and direct the floor maintenance machine 10 about a floor surface.

Notably, a service cabinet 30 is coupled to or supported by the chassis 16 of the floor maintenance machine 10. This service cabinet 30 provides convenient access to various fluid handling subsystems present within the floor maintenance machine 10. As depicted, the service cabinet 30 can be positioned above a rear wheel 18, for example, and can contain a plurality of fluid access points that correspond to multiple fluid handling systems or subsystems present within the housing 20 and the floor maintenance machine 10, generally.

Figure 2:
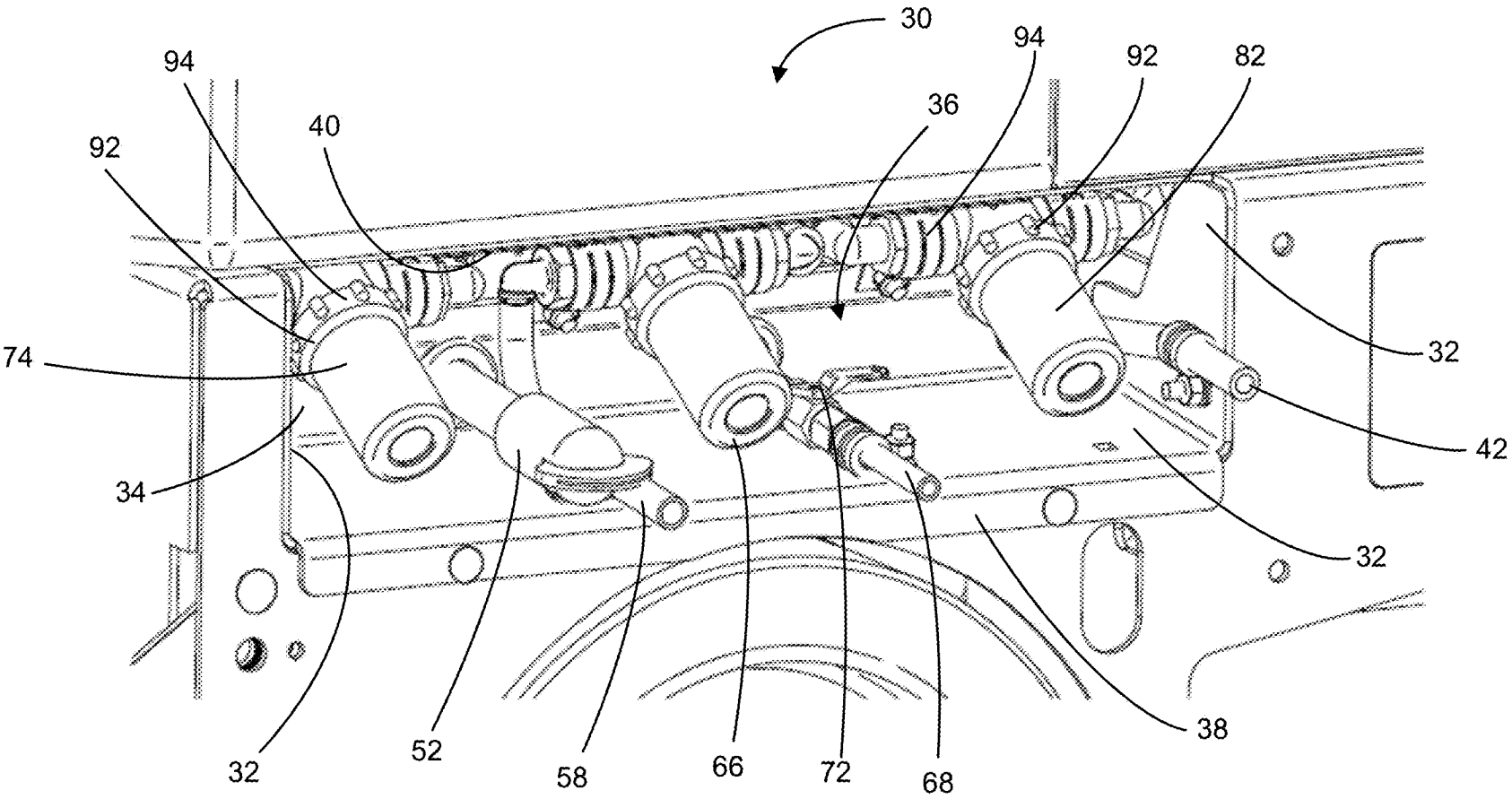
FIG. 2 is a detailed perspective view of a service cabinet of the floor maintenance machine of FIG. 1.

With reference to FIG. 2, the service cabinet 30 structure is shown in detail. In some embodiments, the service cabinet 30 has a plurality of walls 32 extending away from a base surface 34 to define a cavity 36 therein. The plurality of walls 32 and the base surface 34 can be formed of a corrosion-resistant material, such as aluminum, for example, which can be beneficial given the potential exposure to liquids from the machine 10 or the surrounding environment. As illustrated, the service cabinet 30 can be doorless and the cavity 36 can be open to an external environment. However, in some forms, the cavity could be selectively covered by a door or cover (for example, a sliding or hinged door). In some embodiments, a mounting flange 38 extends away from one or more walls 32, and can receive fasteners or rivets to mount the service cabinet 30 to the chassis 16 of the floor maintenance machine 10.

An illumination source 40 can be received within the cavity 36 or positioned proximate to the cavity 25 to further illuminate the service cabinet 30 and highlight its significance. For example, the illumination source 40 could be a light emitting diode (LED) strip coupled to a wall 32 of the service cabinet 30. With additional light in the cavity 36, the fluid access points can be readily inspected, manipulated, or replaced during a maintenance procedure. Further still, by lighting the area of the cabinet 30, the operator's attention may be drawn to the cabinet to ensure that the operator is aware and monitoring the fluid access points therein.

The plurality of fluid access points are collectively received within the cavity 36 of the service cabinet 30, which enables convenient access to several subsystems contained within the floor maintenance machine 10 simultaneously and at a central location. The plurality of fluid access points can include fluid drains, filters, valves, gauges, and/or liquid traps, for example. In some embodiments, the fluid access points can be arranged, at least in part, to direct fluid outward from the service cabinet 30 toward the external environment.

Figure 3:
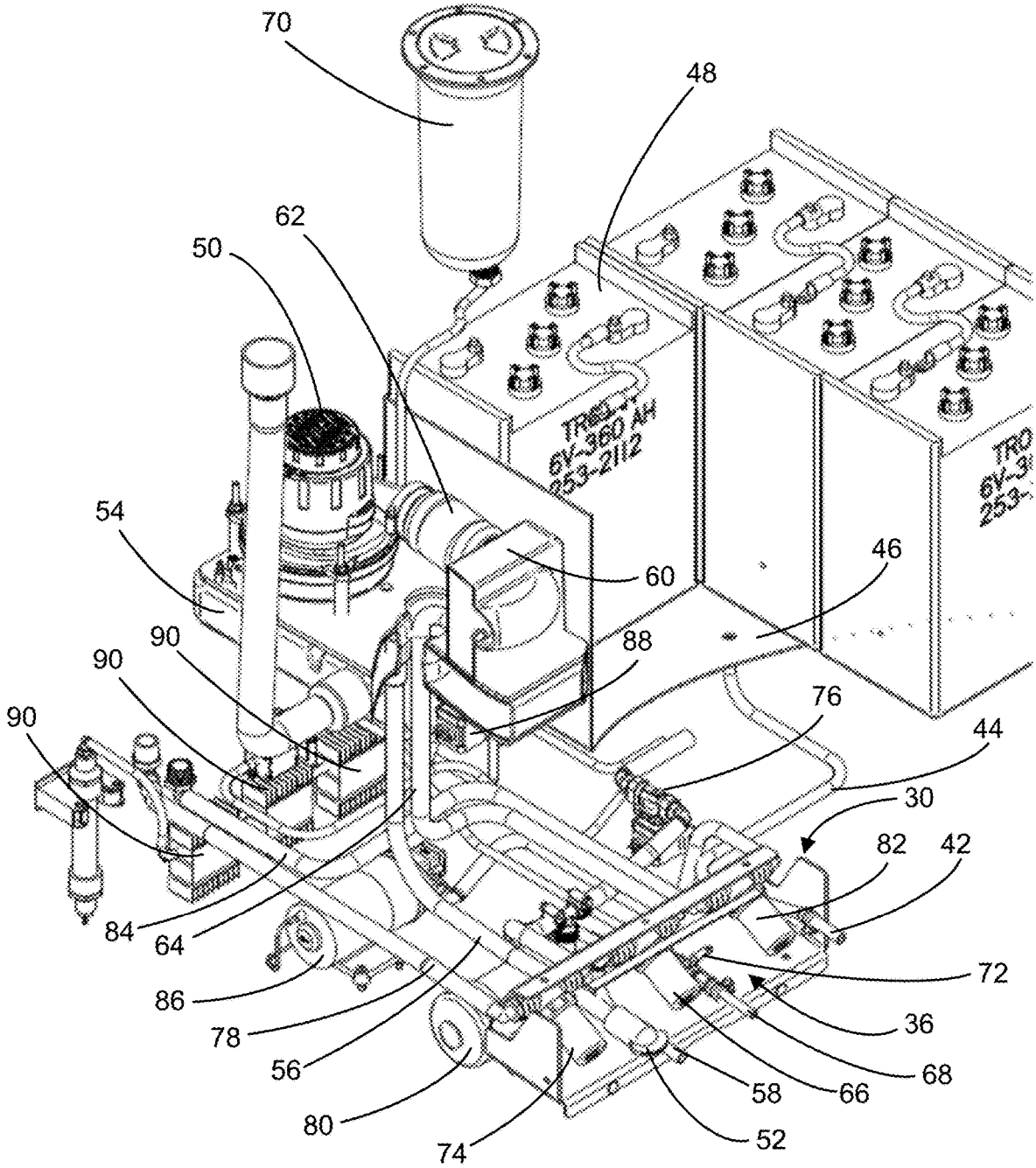
FIG. 3 is a partial perspective view of internal plumbing of some of the subsystems within the floor maintenance machine of FIG. 1.

With reference to FIG. 3, some exemplary fluid handling systems within the floor maintenance machine 10 are shown, with the surrounding parts of the machine 10 being hidden.

As indicated above, the plurality of fluid access points can include a plurality of fluid drains extending outward from the cavity 36 toward an external environment.

In some embodiments, a battery box drain 42 extends into the cavity 36 of the service cabinet 30. The battery box drain 42 can be coupled to and placed into fluid communication with a conduit 44 that extends to a battery box 46 containing a lead acid battery 48. The battery box drain 42 and conduit 44 can together direct liquid contained within the battery box 46 outward from the battery box 46, into the cavity 36, and outward away from the service cabinet 30 toward the external environment. In some embodiments, the battery box drain 42 extends through the base wall 34 and entirely through the cavity 36 to the external environment. A clamp valve (not shown) can be received around a portion of the battery box drain 42 to selectively restrict the flow of fluid out of the battery box drain 42. With the clamp valve, a user can control the location and time that battery acid or other liquid will be released from the battery box 46, which can help promote easier and more efficient battery acid disposal while also preventing unwanted spills or damage to floor surfaces. In some embodiments, the clamp valve is received within the cavity 36 of the service cabinet 30.

Drainage mechanisms may also be present within a vacuum pathway of the floor maintenance machine 10, which can help maintain a vacuum pump 50 by limiting or preventing water or other liquids from entering into the vacuum pump 50. For example, a vacuum box drain 52 can extend into the cavity 36 of the service cabinet 30 to drain liquid from within the floor maintenance machine 10 before it enters into the vacuum pump 50. The vacuum box drain 52 can be coupled to a vacuum box 54 that extends underneath the vacuum pump 50 or another body that accumulates and traps liquid and debris that is sucked into the floor maintenance machine 10 during operation. Such vacuum systems are shown and described, for example, in U.S. Patent Application Publication No. 2016/0331201 entitled "Fluid Collection System for Floor Maintenance Machine" and published on Nov. 17, 2016, and which is hereby incorporated by reference in its entirety. The vacuum box 54 can be placed in the vacuum pathway, such that the vacuum pump 50 creates low pressure within the vacuum box 54 during use. A vacuum box drain pipe 56 can extend away from the vacuum box 54 toward the vacuum box drain 52, and can use gravity direct fluids and debris outward toward the vacuum box drain 52.

The vacuum box drain 52 can be a duckbill valve that selectively drains fluids from the vacuum box 54 into the cavity 36 and outward from the service cabinet 30. The duckbill valve 52 can effectively operate as a check valve. When the vacuum pump 50 is operating, the low pressure within the vacuum box 54 maintains closure of the duckbill valve 52, so that fluid is restricted from exiting the cavity 36 of the service cabinet 30. However, once the vacuum pump 50 is shut off and the pressure within the vacuum box 54 returns to near atmospheric conditions, the duckbill valve 52 opens and allows liquid to drain outward through the cavity 36 and out of the service cabinet 30, where it can be collected by a towel or mop, for example.

To further aid the vacuum pump 50 and reduce the handling of fluids that could affect the strength of the vacuum created (and therefore the suction provided) or the effectiveness of the vacuum pump 50, a muffler box drain 58 can be included in the service cabinet 30. The muffler box drain 58 can be placed in fluid communication with a muffler box 60 that is positioned within the vacuum pathway to collect and remove liquid and debris from the vacuum pathway that has passed through the vacuum pump 50. The muffler box 60 can be positioned above the vacuum box 54, and can be placed downstream of the vacuum pump exhaust muffler 62 to receive exhaust gas and moisture from the vacuum pump 50 while also muffling the noise created during vacuum pump 50 operation. Liquid present in the vacuum pump exhaust gas can settle to the bottom of the muffler box 60, which is then transported out of the muffler box 60 through the muffler box conduit 64, which can extend through a channel formed in the vacuum box 54. Assisted by gravity, the muffler box conduit 64 can direct water, debris, or other liquid present in the muffler box 60 away from the vacuum pump 50, into the cavity 36, and outward from the service cabinet 30 through the muffler box drain 58, toward the external environment.

Turning to other potential uses of the service cabinet 30, during use of the floor maintenance machine 10, it may be advantageous to know that water or liquid is present within the vacuum pathway or the vacuum pump 50, as that may indicate that some systems are underperforming or are in need of maintenance. To provide this visual indication in some embodiments of the floor maintenance machine 10, the liquid and other fluid from the muffler box 60 and muffler box conduit 64 first passes through a water trap 66 before exiting outward through the outlet of the muffler box drain 58. The water trap 66 can be positioned between the outlet of the muffler box drain 58 and downstream of the muffler box conduit 64 and can act as a reservoir, such that liquid only escapes through the outlet of the muffler box drain 58 once the water trap 66 has overflown. The water trap 66 can be positioned within the cavity 36 of the service cabinet 30 to collect and visually display the trapped water collected from the muffler box 60, prior to it being released through the muffler box drain 58. The water trap 66 can have a substantially transparent body, which allows a user to visually detect the presence of water (or other liquid) within the water trap 66 during or after use of the floor maintenance machine 10. In this way, a user may be able to identify the presence of water within the vacuum pump 50 before the amount of liquid in the vacuum pump 50 is substantial enough to harm the vacuum pump 50 or before the floor maintenance machine 10 loses effectiveness. In contrast, without such an easily viewable trap and conveniently viewably positioned drain, the water might simply drain in an unobserved manner and detection of the condition requiring addressing and/or maintenance may be considerably more difficult to make.

Turning to another fluid subsystem, at times during operation of the floor maintenance machine 10, a user may wish to switch cleaning agents. For example, different detergents may be needed to wash a kitchen and a locker room, respectively. To allow for easy detergent exchange, a detergent reservoir drain 68 can be housed within the cavity 36 of the service cabinet 30. The detergent reservoir drain 68 can be placed in fluid communication with the detergent reservoir 70, and can be configured to direct detergent outward from the detergent reservoir 70, into the cavity 36, and away from the service cabinet 30 toward the external environment, where it can be rebottled, for example. The detergent reservoir drain 68 can include a valve 72 housed within the service cabinet 30, which provides selective fluid communication between the detergent reservoir 70 and the external environment. To drain detergent from the detergent reservoir 70, a ball valve 72 can be opened, which causes the detergent within the detergent reservoir to travel downward through the detergent drain 68, through the cavity 36, and outward from the service cabinet 30 toward the external environment. Once the detergent contained within the detergent reservoir has been emptied through the detergent reservoir drain 68, the valve 72 can be closed, and the reservoir 70 can be refilled with different detergent.

In addition to drains, liquid traps, and valves, one or more filters can also be present within the cavity 36 of the service cabinet 30. The filters can be used to remove debris and other solids from fluid used to produce cleaning solutions, and can be incorporated into floor maintenance machines 10 using detergent-based cleaning systems, ozone-based cleaning systems, steam cleaning systems, or combinations of these, for example.

In detergent-based cleaning systems, for example, a water filter 74 can be removably received within the cavity 36 to filter water from a clean water tank (not shown) prior to being used in production of diluted solution or being used at a sprayer, for example. The water filter 74 can be a polymeric or metallic mesh filter, for example, which can remove debris and other solids from the water as it passes through. During operation, water from the clean water tank first passes through feed tube 78 to the water filter 74, which is viewable and accessible from the cavity 36 of the service cabinet 30. After passing through the water filter 74, the filtered water may be combined with detergent from the detergent reservoir 70 at a solution valve 76. At this valve 76, detergent from the detergent reservoir 70 is controllably diluted with water from the water reservoir to produce a desired cleaning solution concentration. Once combined at the solution valve 76, the cleaning solution can be directed toward the scrub deck 20 and the floor cleaning implement 22A, for example. Alternatively, the filtered water can be directed into a spray pump 80, which can pump the filtered water toward a sprayer (not shown) that can disperse the filtered water to the external environment to perform floor maintenance.

In some embodiments, an aqueous ozone cleaning system may be provided within the floor maintenance machine 10 that incorporates an additional, separate fluid filter 82 into the cavity 36 of the service cabinet 30. The aqueous ozone cleaning system can be similar to the aqueous ozone cleaning system shown and described in U.S. Provisional Patent Application No. 62/459,334 entitled "Dual Fluid System for Floor Maintenance Machine" which is hereby incorporated by reference in its entirety. The aqueous ozone cleaning system can be used in combination with a detergent-based cleaning system or independently, depending upon the desired application.

To produce aqueous ozone cleaning solution, water from a water reservoir is first passed through a supply tube 84. In some embodiments, the same water reservoir is used to supply both the supply tube 84 and the feed tube 78 of the detergent-based cleaning system. The water from the supply tube 84 is then passed through a water filter 82 to remove solids and debris contained within the water before it is transported into a water pump 86. The water pump 86 then moves the water toward an ozone injector valve 88, where gaseous ozone produced by the ozone production apparatuses 90 is injected into the water before being transported outward toward the cleaning implement 22, for example. Similar to the water filter 74, the water filter 82 can also be a mesh filter. The water filters 74, 82 can have different mesh counts or gauges, and can be color-coded to allow a user to readily distinguish the filters 74, 82 from one another.

Because the filters 74, 82 generally accumulate debris during operation, periodic maintenance or replacement may be necessary, and accessibility to these components is advantageous. The filters 74, 82 can be enclosed by transparent polymeric housings 92, which can be removably coupled to filter fittings 94 received within the cavity 36 of the service cabinet 30. The polymeric housings 92, as well as the filters 74, 82, can angle outwardly from the floor maintenance vehicle 10 and toward the floor to be cleaned. This angle provides improved visibility of the filter 74, 82 contained inside, and also promotes water from the feed tube 78 or supply tube 84 to fill the housings 92, which causes the water to pass into and through the filters 74, 82 contained therein.

By locating fluid access points for the multiple plumbing and fluid handling systems contained in the housing 20 within the cavity 36 of the service cabinet 30, maintenance and proper care can be readily performed to increase the usable life of the floor maintenance machine 10 and increase operator awareness of the maintenance status of the machine. By placing fluid access points within a single service cabinet 30, a user can also perform a wider range of maintenance quickly, without the need for a significant number of tools or component disassembly. The drains can extend entirely through the cavity 36 to the external environment to direct fluids away from the floor maintenance machine 10, where they can be readily cleaned up or contained. By controlling the flow of fluid through the fluid access points, waste and unwanted liquids can be disposed of efficiently and unwanted spills can be reduced.

It should be appreciated that various other modifications and variations to the preferred embodiments can be made within the spirit and scope of the disclosure. Therefore, the disclosure should not be limited to the described embodiments. To ascertain the full scope of the disclosure, the following claims should be referenced.

I claim:

1. A floor maintenance machine, the floor maintenance machine comprising:

a chassis;

a floor-cleaning implement adapted for engagement with the floor and supported by the chassis;

a drainage line extending to an drain outlet; and a water trap placed in fluid communication with the drainage line before the drain outlet, the water trap providing a visible indication of when liquid has been present within the drainage line.

2. The floor maintenance machine of claim 1, further comprising a vacuum pathway and a vacuum pump, at least one of which have the drainage line connected thereto in which the water trap provides a visual indication of when liquid has been present in at least one of the vacuum pathway and the vacuum pump.

3. The floor maintenance machine of claim 2, wherein the drainage line is in fluid communication with a portion of at least one of the vacuum pathway and vacuum pump to collect and direct liquid away therefrom to the service cabinet toward the external environment.

4. The floor maintenance machine of claim 3, wherein the portion of the at least one of the vacuum pathway and vacuum pump to collect and direct liquid away therefrom is a muffler box.

5. The floor maintenance machine of claim 1, wherein the water trap is externally visible on the floor maintenance machine.

6. The floor maintenance machine of claim 1, wherein the floor maintenance machine includes a service cabinet and the water trap is positioned in the service cabinet.

7. The floor maintenance machine of claim 6, wherein the service cabinet is externally visible on the floor maintenance machine and is a cavity that is recessed in with respect to a body of the floor maintenance machine.

8. The floor maintenance machine of claim 7, wherein the service cabinet is above a rear wheel on the body of the floor maintenance machine.

9. The floor maintenance machine of claim 7, wherein the drainage line is also positioned in the service cabinet.

10. The floor maintenance machine of claim 9, wherein the drainage line extends outward from the cavity to direct fluid away from the service cabinet at the drain outlet and toward an external environment.

11. The floor maintenance machine of claim 1, wherein the water trap is transparent.

12. A floor maintenance machine, the floor maintenance machine comprising:

a chassis;

a floor-cleaning implement adapted for engagement with the floor and supported by the chassis; and a service cabinet coupled to the chassis and defining a cavity in a side of the body of the floor maintenance machine, the cavity receiving one or more fluid access points therein.

13. The floor maintenance machine of claim 12, wherein the service cabinet is on a lateral side of the floor maintenance machine.

14. The floor maintenance machine of claim 13, wherein the service cabinet is positioned above a rear wheel.

15. The floor maintenance machine of claim 12, further comprising:

a drainage line extending to an drain outlet; and a water trap placed in fluid communication with the drainage line before the drain outlet, the water trap providing a visible indication of when liquid has been present within the drainage line;

wherein the drainage line and the water trap are received in the cavity of the service cabinet with the drain outlet constituting one of the one or more fluid access points.

16. The floor maintenance machine of claim 15, wherein the water trap is transparent.

17. The floor maintenance machine of claim 15, further comprising a vacuum pathway and a vacuum pump, at least one of which have the drainage line connected thereto in which the water trap provides a visual indication of when liquid has been present in at least one of the vacuum pathway and the vacuum pump.

18. The floor maintenance machine of claim 12, wherein the cavity is doorless and open to an external environment.

19. The floor maintenance machine of claim 12, wherein an illumination source is received within the cavity.

20. The floor maintenance machine of claim 12, wherein the service cabinet has a plurality of walls extending away from a base surface to define the cavity.

* * * * *